US009060618B2

(12) United States Patent
Sommer

(10) Patent No.: US 9,060,618 B2
(45) Date of Patent: Jun. 23, 2015

(54) ADJUSTABLE HEIGHT BED SIDE GUARD DEVICE

(71) Applicant: Christopher William Sommer, Phoenix, AZ (US)

(72) Inventor: Christopher William Sommer, Phoenix, AZ (US)

( * ) Notice: Subject to any disclaimer, the term of this patent is extended or adjusted under 35 U.S.C. 154(b) by 0 days.

(21) Appl. No.: 14/106,833

(22) Filed: Dec. 15, 2013

(65) Prior Publication Data

US 2014/0115862 A1 May 1, 2014

Related U.S. Application Data

(62) Division of application No. 13/602,196, filed on Sep. 2, 2012, now abandoned.

(51) Int. Cl.
*A47C 21/08* (2006.01)

(52) U.S. Cl.
CPC ..... *A47C 21/08* (2013.01)

(58) Field of Classification Search
USPC ..... 5/428, 632, 646, 648, 424, 425, 652, 5/655.9, 657, 658, 636, 657.5, 513
See application file for complete search history.

(56) References Cited

U.S. PATENT DOCUMENTS

| | | | | |
|---|---|---|---|---|
| 3,148,387 | A * | 9/1964 | Sarnie, Jr. et al. | 5/632 |
| 4,872,228 | A * | 10/1989 | Bishop | 5/425 |
| 4,873,734 | A * | 10/1989 | Pollard | 5/425 |
| 6,345,401 | B1 * | 2/2002 | Frydman | 5/636 |
| 6,848,130 | B1 * | 2/2005 | Wilson | 5/425 |
| 7,743,442 | B2 * | 6/2010 | Maloney et al. | 5/655 |
| 8,763,177 | B2 * | 7/2014 | Shah et al. | 5/603 |
| 2010/0077551 | A1 * | 4/2010 | Liu et al. | 5/636 |

* cited by examiner

*Primary Examiner* — William Kelleher
*Assistant Examiner* — Richard G Davis

(57) ABSTRACT

The present invention is an adjustable height bed side guard device and method to reduce the risk of a child from falling out of bed while sleeping and help wean or transition a child away from needing a bed side guard. The bed side guard height can be adjusted and reduced or raised in set time intervals, providing a simple, step-by-step process to help a child become confident as well as subconsciously accustomed to being in a bed. The device comprises at least one elongated bolster with two or more connected layers that are assembled on top of a conventional mattress and secured in operative position along one side of the mattress by a conventional mattress pad or fitted bed sheet covering the mattress and the bolster and is tucked under the mattress. Multiple devices may be used to provide further security on all sides of a bed.

4 Claims, 2 Drawing Sheets

ADJUSTABLE HEIGHT BED SIDE GUARD DEVICE

FIELD OF THE INVENTION

The present invention relates generally to beds having a safety device and more specifically it relates to bed side guard devices to help reduce the risk of falling out of bed.

BACKGROUND OF THE INVENTION

It can be appreciated that bed side guards have been in use for many years to prevent a child from falling out of bed. When children are moved from a conventional crib to a conventional bed, there is a high risk of falling out of bed as the child may accidentally roll or lean over the mattress edge while sleeping. This is because the child is used to sleeping in a crib or other bed with safety barriers that prevent falling from bed and they have not been weaned off the need for a barrier.

Bed side guards in the current art create a physical safety barrier at the edge of a mattress in various ways.

This includes rigid bed side guards that are either strapped to or physically interconnected with the bed and/or mattress to remain in operable position.

For example, U.S. Pat. No. 7,913,333 utilized a rigid vertical safety barrier connected to perpendicular leg rails, which are meant to be "sandwiched between the mattress and the box spring" and thereby securing the bed side guard in operable condition directly at the mattress edge, but not on top of the mattress.

In addition, bed side guards exist that create a safety barrier and remain in operable position when positioned and held in place between a fitted bed sheet and mattress along the mattress edge. This type of bed side guard is not only simple to install but also has the added benefit of reducing the risk of trapping a child's head between the bed side guard and mattress.

For example, U.S. Pat. No. 4,872,228 utilized a cylindrically shaped bolster to form a safety barrier positioned on one side of a conventional bed and retained in place by being covered with a conventional fitted bed sheet.

While existing bed side guard devices may be suitable for the particular purpose to which they address, reducing the risk of falling from bed while sleeping, the main problem with them is that they have only one operable safety barrier height setting (from top of mattress to top of the bed side guard safety barrier height). At some point in time the bed side guard will undoubtedly be removed and the child may not be quite ready to transition from using a bed site guard to not using one without fear of falling out of bed. So while bed side guards in the current art help prevent failing out of bed each time they are used, they do not offer a step-by-step weaning process to slowly withdraw the bed side guard over time and help the child consciously and subconsciously learn where the edge of the bed is and thereby more safely and confidently transition from using a bed side guard to not using one. The ability to adjust safety barrier height would offer a novel way to wean a child off the need for a bed side guard.

In these respects, the adjustable height bed side guard device according to the present invention substantially departs from the conventional concepts and designs of the prior art, and in so doing provides an apparatus primarily developed for the purpose of providing a simple and safe bed side guard device that reduces the risk of falling out of bed as well as helping wean a child off the need for a bed side guard.

SUMMARY OF THE INVENTION

In view of the foregoing disadvantages inherent in the known types of bed side guards now present in the prior art, the present invention provides a new adjustable height bed side guard device. The ability to adjust the safety barrier height of the bed side guard provides a simple and safe device and means of weaning a child from needing a bed side guard and helping them become confident and accustomed to being in a bed without a bed side guard.

The present invention has many of the advantages of bed side guards in the current art as well as novel features that result in a new type of bed side guard, and indeed a new purpose for a bed side guard, which are not anticipated, rendered obvious, suggested, or even implied by any of the prior bed side guards, either alone or in any combination thereof.

To attain this, the present invention is a new type of bed side guard device, with adjustable safety barrier height, intended for placement between a mattress and fitted bed sheet, comprising multiple interlocking or self-adhering components or "Layers" (each component can be considered as a "layer" of the device), which acts as a physical barrier along the edge of a mattress. By removing one or more Layers the safety barrier height may be reduced; by adding Layers height may be increased. The device will ideally be made of material such as polyurethane foam to allow it to be placed between a fitted bed sheet and mattress or mattress pad where it will remain in operable position due to the non-slip nature of the material as well as the tension between the fitted bed sheet and mattress or mattress pad surface and therefore not require a strap or other means of securing it to the bed.

There has thus been outlined, rather broadly, the more important features of the invention in order that the detailed description thereof may be better understood, and in order that the present contribution to the art may be better appreciated. There are additional features of the invention that will be described hereinafter.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide an adjustable height bed side guard device comprising an elongated bolster or safety barrier that comprises one or more layers to form an effective safety barrier to reduce the risk of a child falling out of bed while sleeping as well as wean the child off the bed side guard that will overcome the shortcomings of the prior art devices. This device will ideally be placed and held in operable position along the long edge of a mattress while placed between the mattress or mattress pad and the fined bed sheet, which is fitted over the mattress's entire top surface and tucked under the mattress edges to secure it in place.

Another object is to provide an adjustable height bed side guard device offering multiple safety barrier height levels.

Another object of the present invention is to provide an adjustable height bed side guard device for which the safety barrier height is quickly and easily increased or decreased.

Another object is to provide an adjustable height bed side guard device that does not need a secondary means of securing itself to the bed or mattress such as a strap or physical feature that tucks under the mattress.

Another object is to provide an adjustable height bed side guard device that can be manufactured with minimal materials and components. For example, by forming the layers of the bolster from polyurethane foam engineered with interlocking features, only one material and minimal steps would be required to manufacture the entire device.

A representative embodiment of the present invention may provide an adjustable height bed side guard device with 2 or more interlocking or self-adhering layers that combine to form one bed side guard.

Other embodiments and advantages of the present invention will become obvious to the reader and it is intended that these embodiments and advantages are within the scope of the present invention.

To the accomplishment of the above and description of alternate embodiments, this invention may be embodied in the form illustrated in the accompanying drawings, attention being called to the fact, however, that the drawings are illustrative only, and that changes may be made in the specific construction illustrated.

BRIEF DESCRIPTION OF THE DRAWINGS

Other representative embodiments, features and attendant advantages of the present invention may become fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
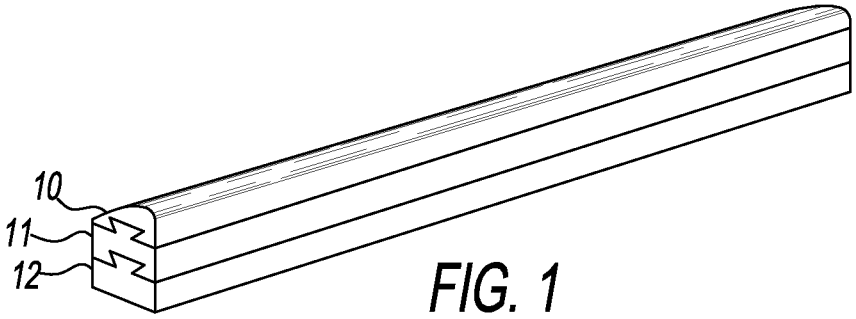
FIG. 1 is a perspective view of the present invention, with three layers: the Top Layer 10, Middle Layer 11, and Bottom Layer 12, from the perspective of the inner side that faces the child sleeping in the bed and forms the vertical safety barrier.
Figure 2:
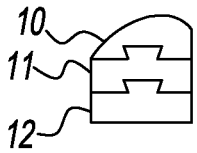
FIG. 2 is an elevation view of one end of the present invention.
Figure 3:
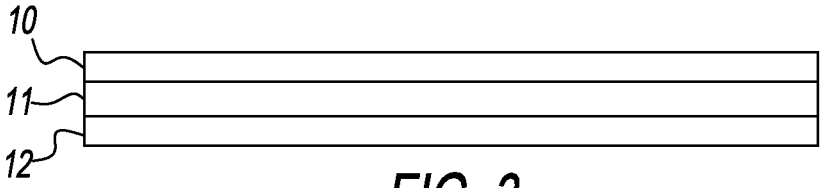
FIG. 3 is an elevation view of the present invention, from the perspective of the inner side that faces the child sleeping in the bed and forms the vertical safety barrier.
Figure 4:
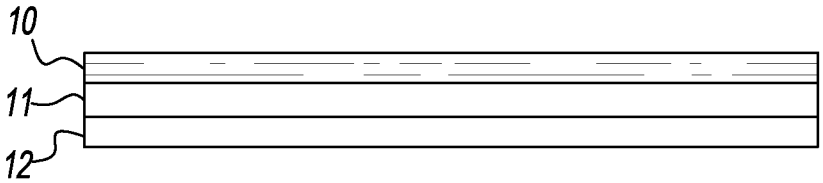
FIG. 4 is an elevation view of the present invention, from the perspective of the outer side, which faces towards the edge of the mattress.
Figure 5:
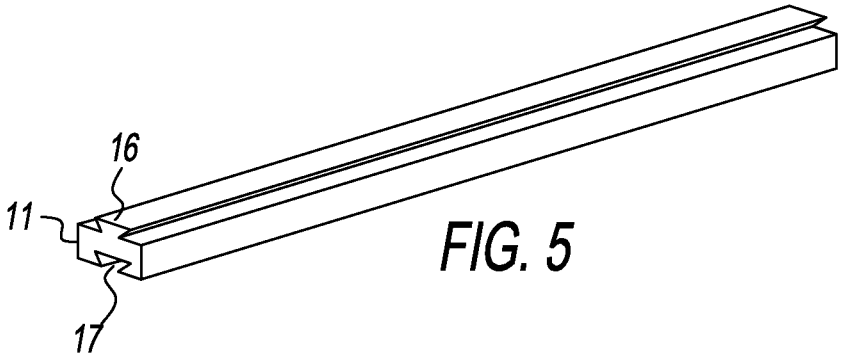
FIG. 5 is perspective view of the Middle Layer component of the present invention, to clearly demonstrate the male interconnection feature 16 and female interconnection feature 17, which run the length of the component.

Turning now descriptively to the drawings, in which similar reference characters denote similar elements throughout the several views, the attached figures illustrate an adjustable height bed side guard device intended for placement between a mattress and fitted bed sheet comprising a bolster created from multiple interlocking or self-adhering components or "layers" (each component can be considered as a "layer" of the bolster), which act as a physical barrier at or near the edge of a mattress. When interlocked together they form a safety barrier that when installed properly can help prevent a child from falling out of bed. By removing layers the barrier height may be reduced; by adding layers height may be increased. The bed side guard will ideally be made from material such as polyurethane foam to allow it to be placed between a fitted bed sheet and a mattress where it will remain in operable position and therefore not require a strap or other means of securing it to the bed.

Each layer of the bed side guard is comprised ideally of firm but not rigid, washable, non-allergenic and flame retardant material, such as treated polyurethane foam, but could be of many different child-safe materials that are able to hold the proper form. Each layer is ideally of the same length and width, but height may vary. Length of each layer would ideally be four feet or more to match or exceed the height of a child. Additionally, each layer would ideally be about one and a half to two inches in height and six inches deep (front to back) to form a bolster with sufficient height and thickness to be effective as a bed side guard as well as have enough depth and surface area contact with the mattress and fitted bed sheet to remain operable position and avoid slipping.

As shown in FIG. 1, the Top Layer 10 interconnects with Middle Layer 11, which interconnects with the Bottom Layer 12 to form a variable height bolster, which acts as a bed side guard when placed between a mattress or mattress pad and a fitted bed sheet. The long, inner side of the bed side guard is intended to face the child sleeping in the bed and form a flat, vertical edge to act as a safety barrier.

To create a more attractive look and be less noticeable under a fitted bed sheet, the top side of the Top Layer 10 should resemble the top side of an airplane wing: The top side of the Top Layer 10 would ideally have one long edge (the inner edge that faces toward the child) with slight rounding for a smoother and less obvious appearance under the fitted bed sheet, like the leading edge of a wing. The outer edge of the top side of the Top Layer 10 (which faces away from the child and toward the mattress edge) should be more streamlined, like the trailing edge of a wing, with a downward angled convex slope.

The bottom side of the Top Layer 10 could have a female interlocking feature 15 to interconnect to a male interlocking feature 16 of another layer (e.g. male to female connection to Middle Layer 11 or Bottom Layer 12).

The top and bottom sides of Middle Layer 11 would have male/female interlocking features to interconnect with the Top 10 and Bottom 12 Layers.

The top of Bottom Layer 12 would have a male interlocking feature to interconnect with Top 10 or Middle 11 Layers. The bottom side of Bottom Layer 12 would be flat, with no interlocking feature.

For illustrative purposes three layers have been described as forming a functioning device. However, the device could comprise only two layers, or more than three Layers, necessitating more or fewer middle layers. Further, the child's bed is assumed to be either tightly against a wall (forming a barrier) with the device placed on the non-wall side, or if not against a wall, two devices could be used to form barriers, one along either long side of the mattress, Finally, an additional number of devices could be employed to effectively surround the child.

Figure 6:
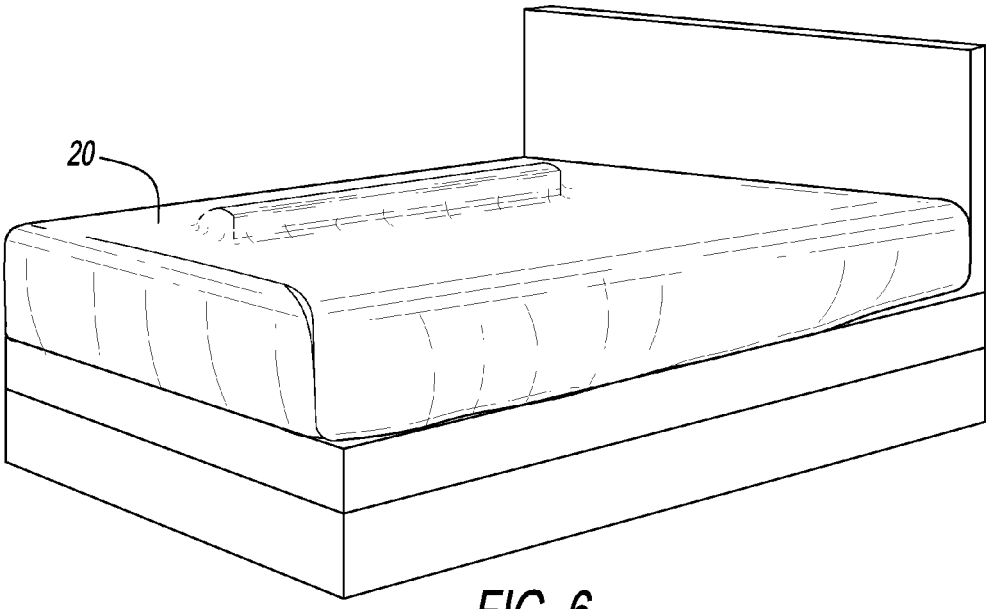
FIG. 6 is a perspective view of the present invention placed under a fitted bed sheet 20 installed on a conventional bed mattress.

Normal use would start with all Layers interconnected, as shown in FIG. 1, forming a full height of perhaps but not limited to 4.5 to 6 inches (as shown in FIG. 6 this device would ideally be placed under the fitted bed sheet 20 and above the mattress or mattress pad). The child would begin use with the device at full height and use it for a period of time, perhaps 1 month or more, as they gain confidence in the bed. This not only reduces the risk of falling out of bed but also helps them become acclimated and familiar, both consciously and subconsciously, with where the edge of the bed is located. After a period of time, perhaps 1 month or more, the Middle Layer 11 could be disconnected and removed from the Top Layer 10 and Bottom Layer 12 and the Top 10 and Bottom 12 Layers could be manually interconnected to form a bolster with a lower height and placed back between the mattress or mattress pad and fitted bed sheet. The device is now reduced in height and therefore offers a lower safety barrier, but still aids in preventing the child falling out of bed. This continues to help them become acclimated and familiar with where the edge of the bed is located. After an additional period of time, perhaps 1 month or more, the Bottom Layer 12 could be disconnected from the Top Layer 10 to form a bolster with lowest height, and only the Top Layer 10 would remain. It would be placed back between the mattress or mattress pad and fitted bed sheet. The device is now reduced to its "minimal height" and therefore the barrier is lower, but still aids in preventing the child falling out of bed. This continues to help them become acclimated and familiar with where the edge of the bed is located. After a final period of time, perhaps 1 month or more the Top Layer 10 could be removed, and therefore no Layers would remain and the bed side guard device would be completely removed from the bed at this point. Ideally by this time the child has become effectively weaned off the bed side guard, is acclimated and familiar with where the edge of the bed is located and has gained confidence to sleep in the bed without a bed side guard.

Figure 7:
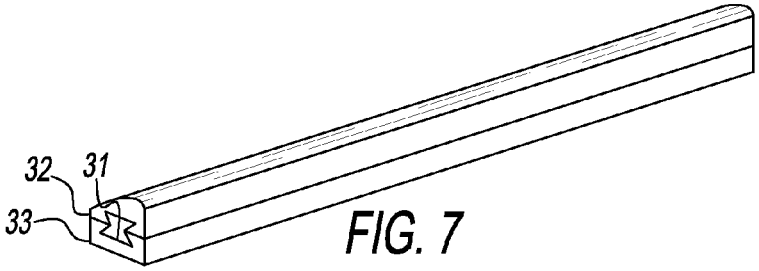
FIG. 7 is a perspective view of an alternate embodiment.
Figure 8:
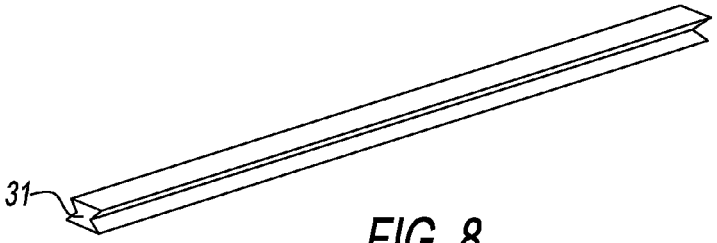
FIG. 8 is a perspective view of a double-sided male-male interconnector piece within the alternate embodiment shown in FIG. 7.

The bed side guard device or its components could be constructed of myriad materials that are able to take the proper shape of the bolster and have appropriate firmness to perform the task. The device could also be covered in myriad materials known in the arts to facilitate or improve connection to other layers or provide natural adhesion/non-slipping with fitted bed sheet, mattress pad or mattress. Materials used could also provide greater aesthetics, fire retardation or other safety features, Alternate variations of connecting or interlocking technique could be used rather than those described, herein. For example, a single and separate interlocking piece 31 such as shown in FIG. 7, could be used to connect a Top Layer 32 and Bottom Layer 33.

Alternate methods to keep the Layers together could be used by various means of adhesion (e.g., Velcro, non-permanent sticking various glues, etc.), which would avoid use of interlocking male/female structural features.

In addition, the ends of the device could comprise features to interconnect or adhere to the ends of additional devices to create a geometrically shaped enclosure and effectively surround a child.

Alternative variations of the device could comprise a single bolster, perhaps 4.5 to 6 inches thick, with perforated lateral layers that could be peeled away to reduce the height of the safety barrier.

Instead of creating the bolster Layers from material that naturally adheres to mattress and bed sheet materials, such as polyurethane foam, the entire device could be secured to the mattress, above or below the fitted bed sheet, using conventional means known in the arts, such as straps.

Instead of using multiple interlocking layers to achieve various adjustable heights alternate variations of the device could be constructed differently, such as using an inflatable bed side guard with multiple air chambers (all chambers inflated for max height, fewer for lower height) or perhaps one air chamber that self adjusts in height when inflated with more or less air.

The described device is an adjustable bed side guard comprised of 3 interlocking pieces, which allow the user to set the height of the bed side guard. Ideally, to use the invention, it would be used on a standard bed, with mattress, mattress pad, and fitted bed sheet. It would be placed between the mattress pad (which is above the mattress but below the sheet) and fitted bed sheet. As it is ideally constructed of material that naturally adheres to common fabrics used in bed sheet or mattress construction and so is slip resistant, it will stay in operable position without the use of straps or other means. To set the bed side guard at its highest level, all 3 pieces would be interlocked or fitted together. To reduce the height, one or more layers could be removed. To re-raise the height, one or more layers could be added.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A method of using a bed side guard device to reduce the risk of a child falling out of bed, the device comprising two or more layers forming a bolster adjustable in height;

the method comprising the steps of:

a. installing on a top surface of a bed or mattress the device at a full height;

b. reducing the device height after a period of time by removing one of said layers, said period of time corresponding to a time sufficient to allow a child to become acclimatized to the device at a given device height;

c. repeating the step of reducing the device height until the lowest height setting is reached;

d. removing the device entirely after a period of time;

whereby the child has been acclimatized to not having a bed side guard device and will be less likely to fall out of bed.

2. A method according to claim 1 wherein the device is placed in operable position between a fitted bed sheet and a mattress or mattress pad.

3. A method according to claim 2 wherein the device does not need a secondary means of securing itself to the bed or mattress to remain in operable position.

4. A method according to claim 1 wherein a top side outer edge of the device comprises a convex downward sloping curve to minimize appearance under a fitted bed sheet.

* * * * *